US007207073B1

(12) United States Patent
Blankenburg

(10) Patent No.: US 7,207,073 B1
(45) Date of Patent: Apr. 24, 2007

(54) VACUUM ASSISTED TOILET

(75) Inventor: Karl Blankenburg, Warren, MI (US)

(73) Assignee: The American Team, Mt. Clemens, MI (US)

( * ) Notice: Subject to any disclaimer, the term of this patent is extended or adjusted under 35 U.S.C. 154(b) by 841 days.

(21) Appl. No.: 10/329,617

(22) Filed: Dec. 26, 2002

Related U.S. Application Data

(63) Continuation of application No. 09/982,424, filed on Oct. 18, 2001, now abandoned.

(51) Int. Cl.
*E03D 11/00* (2006.01)

(52) U.S. Cl. ..... 4/431; 4/321

(58) Field of Classification Search ..... 4/321, 4/328, 426, 431, 434
See application file for complete search history.

(56) References Cited

U.S. PATENT DOCUMENTS

| | | | | | |
|---|---|---|---|---|---|
| 3,239,849 | A | | 3/1966 | Liljendahl | 4/431 X |
| 3,629,099 | A | * | 12/1971 | Gahmberg et al. | 4/321 X |
| 3,995,328 | A | | 12/1976 | Carolan et al. | 4/316 |
| 4,041,554 | A | | 8/1977 | Gregory et al. | 4/316 X |
| 4,063,315 | A | | 12/1977 | Carolan et al. | 4/316 |
| 4,115,883 | A | * | 9/1978 | Dauvergne | 4/426 X |
| 4,143,433 | A | | 3/1979 | Skousgaard | 4/354 |
| 4,144,903 | A | | 3/1979 | Gregory et al. | 137/624.11 |
| 4,184,506 | A | * | 1/1980 | Varis et al. | 4/431 X |
| 4,199,828 | A | * | 4/1980 | Hellers | 4/321 |
| 4,232,409 | A | | 11/1980 | Van Pham | 4/362 |
| 4,237,934 | A | | 12/1980 | Gregory et al. | 137/637 |
| 4,246,925 | A | | 1/1981 | Oldfelt | 4/431 X |
| 4,275,470 | A | | 6/1981 | Badger et al. | 4/431 X |
| 4,297,751 | A | * | 11/1981 | Olin et al. | 4/431 |
| 4,521,925 | A | | 6/1985 | Chen et al. | 4/362 |
| 4,955,091 | A | | 9/1990 | Grills et al. | 4/321 |
| 5,142,712 | A | | 9/1992 | Hennessy | 4/431 |
| 5,214,807 | A | | 6/1993 | Terve | 4/321 |
| 5,241,711 | A | | 9/1993 | Badders | 4/359 |
| 5,282,281 | A | | 2/1994 | Clear et al. | 4/434 |
| 5,361,426 | A | | 11/1994 | Martin | 4/361 |
| 5,363,510 | A | | 11/1994 | Chlebek | 4/321 |
| 5,363,513 | A | | 11/1994 | Blankenburg | 4/354 |
| 5,369,811 | A | | 12/1994 | Serre | 4/431 X |
| 5,386,596 | A | | 2/1995 | Hennessy | 4/328 |
| 5,406,652 | A | | 4/1995 | Hennessy | 4/354 |
| 5,408,704 | A | | 4/1995 | Bailey et al. | 4/431 X |
| 5,426,794 | A | | 6/1995 | Hennessy | 4/431 |
| 5,435,019 | A | | 7/1995 | Badders | 4/359 |
| 5,454,936 | A | | 10/1995 | Ask et al. | 4/431 X |
| 5,487,193 | A | | 1/1996 | Hennessy | 4/354 X |

(Continued)

*Primary Examiner*—Robert M. Fetsuga
(74) *Attorney, Agent, or Firm*—Young Basile Hanlon MacFarlane & Helmholdt

(57) ABSTRACT

A toilet is provided with a vacuum to assist in the flushing process. The vacuum is provided downstream between the toilet bowl and a waste outlet to draw the waste contents of the toilet bowl and out of the toilet bowl to the waste outlet under pressure. A controllable valve connected to a vacuum source is connected in a discharge passage between the toilet bowl and the waste outlet. The valve is opened to apply vacuum to the discharge passage upon activation of a toilet flush actuator and closes prior to the waste contents of the toilet bowl reaching the location of the valve. A normally closed flap valve is connected between the discharge passage and the waste outlet to define a minimal amount of air in the discharge passage which is removed by the vacuum.

6 Claims, 2 Drawing Sheets

U.S. PATENT DOCUMENTS 5,502,845 A 4/1996 Hayashi et al. ..... 4/300
5,515,555 A 5/1996 Wormcke ..... 4/431
5,621,924 A * 4/1997 Friedman et al. ..... 4/431
5,802,628 A 9/1998 Spoeth et al. ..... 4/354 X
5,857,224 A 1/1999 Oberg et al. ..... 4/354
6,029,287 A 2/2000 Ge et al. ..... 4/354

* cited by examiner

VACUUM ASSISTED TOILET

CROSS REFERENCE TO CO-PENDING APPLICATION

This application is a continuation of U.S. patent application Ser. No. 09/982,424, filed Oct. 18, 2001 in the name of Karl Blankenburg and entitled "VACUUM ASSIST TOILET", abandoned, the contents of which are incorporated herein in its entirety.

BACKGROUND

This invention relates to a vacuum assisted toilet that uses less water than a conventional toilet. Specifically, the invention refers to a method and apparatus for creating a vacuum downstream of the toilet and upstream of a discharge pipe leading to a sewer pipe or a waste holding tank.

Reducing the amount of water used for each flush has long been a goal of designers of waste removal, or toilet systems. Pursuing this goal has been attempted predominantly in two ways. First, designers have implemented pressurized water holding tanks above the toilet so that water at elevated pressure levels enters the bowl during the flush cycle. Second, designers have applied a vacuum force downstream from the toilet. This second approach, in turn, can be divided generally into two categories. The first category is demonstrated by airplane toilet systems. In these devices a vacuum is applied downstream from a holding or receiving tank. Thus, the vacuum force is applied both to the receiving tank, the discharge trapway and the toilet. The second category of vacuum assisted toilets in the art is a vacuum situated along the discharge trapway that ramps up in intensity as the flushed water evacuates the bowl.

The shortcoming of each of these types of vacuum assisted toilets is that the evacuator force of the vacuum is used inefficiently. The less water used during a flush, the more efficient a toilet is. In the airplane toilet systems, the evacuator force is not applied in the discharge trapway alone. Rather, the vacuum is applied to a holding tank as well. It is in the discharge trapway where the vacuum is most needed. When the evacuator force has been applied along the discharge trapway, it has been inefficient in that the force increases in intensity only when the leading edge of the flushed water has passed. As a result, the highest levels of evacuator force produced by the prior known devices is directed to the flushed water in a direction away from the holding or receiving tank.

It would be desirable to provide a toilet system where vacuum is created between the toilet and the discharge piping or a receiving tank, such that the vacuum acts to draw the flushed water from the toilet, through the discharge piping, and to the receiving tank. Further it would be desirable to apply this evacuator force at a location along the discharge passage so that the maximum amount of force is applied to draw the contents of the toilet bowl out of the toilet bowl and into the discharge piping.

SUMMARY OF THE INVENTION

The present invention provides a highly efficient vacuum assisted toilet. The invention is a toilet having a bowl capable of containing a waste liquid, a flushing actuator to initiate flushing of the toilet bowl, and a discharge port. A discharge passage is fluidically connectable to the discharge port of the toilet and to a waste outlet. A source of vacuum is fluidically connectable to the discharge passage in response to activation of the flushing actuator to withdraw the waste liquid from the toilet bowl under pressure through the discharge passage to the waste outlet.

The toilet can also include a vacuum application valve, a vacuum reservoir and an air compressor or pump. The reservoir can be connected to the valve at one end and, at the other end, to an inlet of an air compressor or pump. In addition to being connected to the reservoir, the valve is connectable to the discharge passage. The air compressor or pump draws gas out of the vacuum reservoir while the valve is closed, thus creating a vacuum in the reservoir.

The toilet of the present invention also includes a flap valve which is located downstream in the discharge passage. The flap valve is positioned at a location in between the vacuum valve and the waste outlet. The flap valve is essentially a one way valve preventing gas or liquid from flowing upstream to the toilet and creating a smaller downstream chamber.

When the toilet is flushed by activation of the flushing actuator, the valve opens drawing gas and/or air within the discharge passage into the reservoir. As a result, vacuum is created in the discharge passage. The opening of the valve is coordinated with the activation of the flushing mechanism of the toilet. Once vacuum has been created in the discharge passage for a predetermined time, the valve shuts such that none of the waste liquid in the toilet bowl enters the valve or the reservoir.

The vacuum assisted toilet of the present invention can also include a vacuum level switch. The vacuum level switch is positioned on the vacuum reservoir and permits the level of vacuum within the reservoir to be modified. Modifying the degree of vacuum within the reservoir can be used to modify the characteristics of the flushing operation.

The vacuum assisted toilet of the present invention can also include a control module for controlling the operation of the toilet components. The control module, for example, can control the opening and closing of the vacuum application valve, the function of the pump and, optionally, the operation of the flap valve. The addition of the control module can further enhance the efficiency of the flushing operation.

The present invention also teaches a method for providing vacuum pressure to assist in the flushing of a toilet. A flushable toilet system is provided. The system can include a toilet and a passage leading to a waste discharge outlet. A source of vacuum is provided and fluidly connected to the discharge passage. The vacuum source can be closed from communication with the discharge trap so that waste liquid from the toilet will not enter the vacuum source. When the toilet is flushed, the vacuum source is placed in communication with the discharge passage for a desired length of time. The vacuum source can be closed before the waste liquid from the toilet reaches the vacuum source.

BRIEF DESCRIPTION OF THE DRAWINGS

The various features, advantages and other uses of the present invention will become more apparent by referring to the following detailed description and drawing in which.

DETAILED DESCRIPTION

Figure 1:
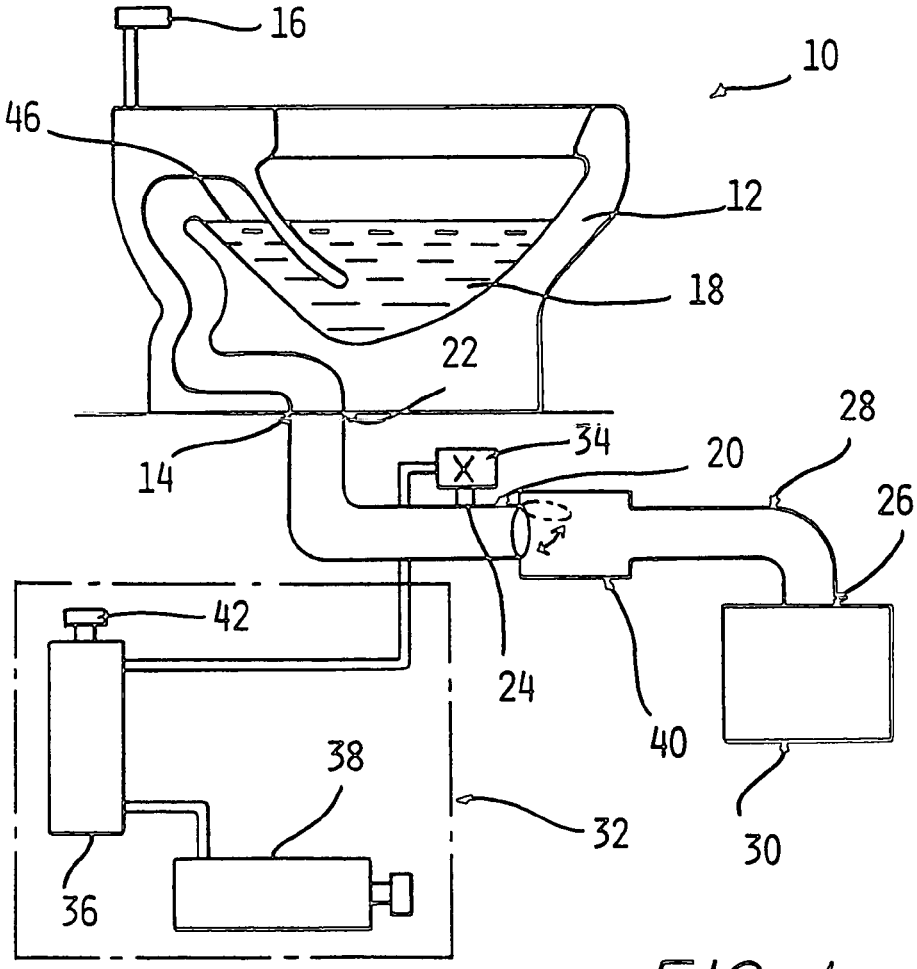
FIG. 1 is a schematic diagram of a vacuum assisted toilet according to the present invention.

Referring to FIG. 1, a vacuum assisted toilet 10 of the present invention is depicted. The toilet 10 according to the present invention includes a bowl 12, a discharge port 14 and a flushing actuator 16. The bowl 12 of the toilet 10 is capable of containing a waste water or liquid stream 18. During a flush cycle, the waste stream 18 in the bowl 12 is evacuated through the discharge port 14. The discharge port 14 is fluidly connected to a discharge passage 20. In addition, in a preferred aspect, the discharge passage 20 is a pipe with multiple openings 22 and 24, which joins the toilet 10 to a waste outlet through a discharge pipe 28. Generally, the discharge pipe 28 can be connected at a waste outlet or opening 26 to a holding device 30, by way of example and not limitation, such as a holding tank or septic tank. Alternatively, the discharge pipe 28 can be connected at opening 26 to a sewer line. The discharge passage 20 can include a trap that is essentially a local valley in the discharge passage 20 that will collect water and the like for preventing gas and liquid from evacuating from the discharge pipe 28 while allowing the waste water stream 18 to travel along the discharge pipe 28.

The discharge passage 20 extends a predetermined length from the toilet 10 to the discharge pipe 28. A vacuum source 32 is attached to the discharge passage 20 at some point between the toilet 10 and the discharge pipe 28, preferably at a point above the center line of the discharge passage 20. The vacuum source 32 is fluidly connected to the discharge passage 20. The vacuum source 32 can include a valve 34 that is operable such that the waste water stream 18 from the toilet 10 will be prevented from flowing into the vacuum source 32.

In one aspect of the invention, the vacuum source 32 can include the valve 34, a vacuum reservoir 36 and a pump 38. The valve 34 is fluidly connected to the discharge passage 20 and to the reservoir 36. The opening and closing of the valve 34 is subject to the initiation of a flushing cycle in the toilet 10. The valve 34 opens for a relatively brief period of time, when the flushing actuator 16 is used to initiate a flushing cycle.

The vacuum reservoir 36 is fluidly connected to the valve 34 and the pump 38. The reservoir 36 is a relatively rigid container capable of sustaining a predetermined shape while storing a vacuum of desired strength. The pump 38 is attached to the reservoir 36 and draws fluid from the reservoir 36. The pump 38, by way of example and not limitation, can take the form of a blower, an air compressor or any similarly functioning apparatus now known or later developed in the art.

Although the reservoir 36 and the pump 38 may be mounted in any convenient location within a building or home, a preferred mounting location is between the wall studs in the bathroom or directly below the bathroom in a basement or crawlspace, if such is available.

In addition, although FIG. 1 and the description of the toilet 10 describe the use of the reservoir 36 and pump 38 with a single toilet 10, it will be understood that a single reservoir 36 and a single pump 38 may be employed with multiple toilets 10 in various locations throughout a home or building. In such a multi-toilet application, a separate valve 34 is provided for each separate toilet 10 and is mounted in the same manner as that described above and shown in FIG. 1 in fluid communication with the discharge passage 20 and a conduit extending to the reservoir 36.

The vacuum assisted toilet 10 includes a flap valve 40 positioned within the discharge passage 20 at a location between the port or outlet 24 to the valve 34 and the discharge pipe 28. The flap valve 40 prevents upstream flow. As used herein, "upstream flow" refers to travel along the discharge passage 20 from the discharge pipe 28 to the toilet 10. In an example, the flap valve 40 takes the form of a flap or one-way valve. The vacuum created by the vacuum source 32 draws waste water 18 out of the toilet 10. The flap valve 40 is added to the discharge passage 20 prior to communication with the discharge pipe 28 to produce a greater vacuum in the discharge passage 20.

The flap valve 40 is in a normally closed position closing the discharge passage 20 to flow of waste water stream 18 at the time of activation of the flushing actuator 16 and the application of the vacuum to the discharge passage 20.

The toilet 10 can also include a switch 42, as is shown in FIG. 1, for controlling the degree of vacuum within the vacuum reservoir 36. As is well known, "vacuum" is a state of lower pressure. The lower the pressure, in comparison to the pressure of the ambient air, the greater the "degree of vacuum." A vacuum level switch 42 may be added to the vacuum reservoir 36 in order to calibrate the degree of vacuum to an optimum level. The vacuum level switch 42 can be manual or automated.

Figure 2:
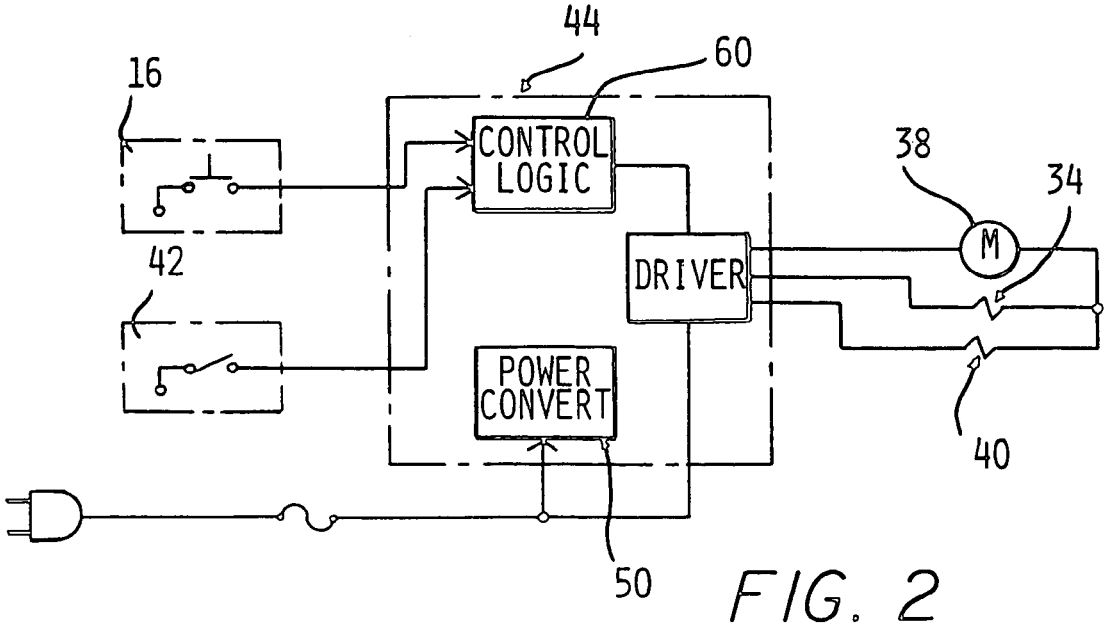
FIG. 2 is a block diagram of the control for the present vacuum assisted toilet.

The present invention can also include a control module 44 for controlling the function of the present toilet. As best shown in FIG. 2, in a preferred embodiment, the control module 44 controls the operation of the valve 34 to move to an open fluid flow state, when the flushing actuator 16 of the toilet 10 is activated. The control module 44 can optionally control the motion of the flap valve 40 positioned within the discharge passage 20. The control module 44 can also control the operation of the vacuum pump 38 or air compressor for negative pressure, and the vacuum level switch 42.

Figure 3:
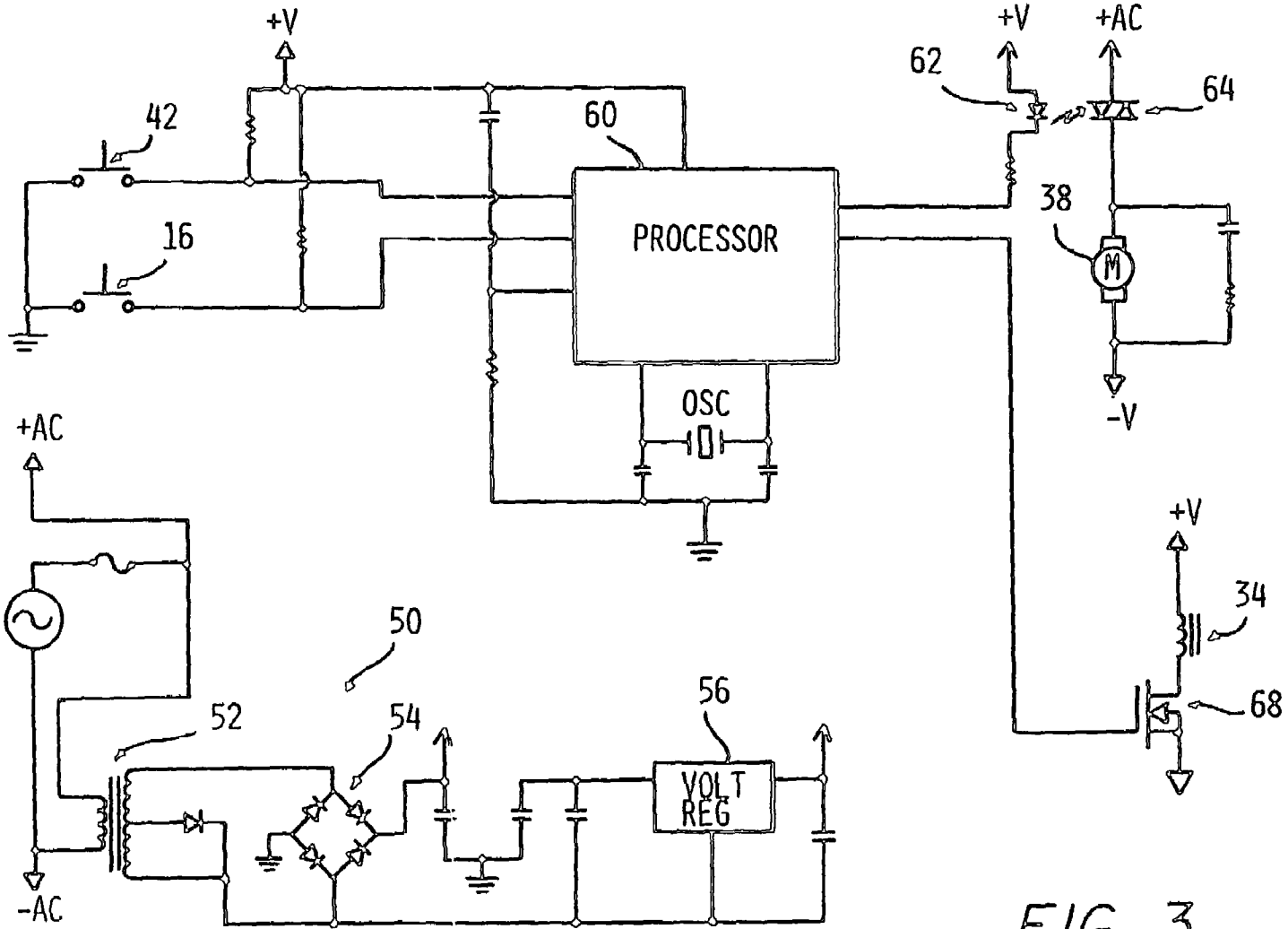
FIG. 3 is a schematic diagram of circuitry for controlling the operation of the present invention.

The control module 44 includes a power convert circuit 50, shown in detail in FIG. 3. The power convert circuit 50 includes a transformer 52 which converts incoming A.C. line voltage to a stepped down A.C. voltage. A full wave bridge 54 is connected to the output of the transformer 52 to convert the stepped down A.C. voltage to a D.C. voltage suitable for use with the electronic components used in the control module 44. A voltage regulator 56 is coupled to the output of the bridge 54 to maintain a regulated voltage for of the circuitry of the control module 44.

The control module 44 also includes a control logic circuit in the form of a microprocessor 60 which executes a stored control program. The flush actuator switch 16 of the toilet 10 and the vacuum level switch 42 are input to the microprocessor 60. Outputs from the microprocessor 60 are connected to the vacuum valve 34 and the motor/pump 38 attached to the reservoir 36. An optional output is provided from the microprocessor 60 to the flap valve 40.

Drivers or relays are connected between the outputs of the microprocessor 60 and the various output devices to provide isolation as well as to enable the necessary voltage, typically an A. C. voltage, to be provided to the motor/pump 38 or a low level D.C. voltage to the solenoid of the vacuum valve 34.

Thus, as shown in FIG. 3, one output of the microprocessor 60 drives a light emitting diode 62 connected to a light responsive triac driver 64. The triac driver 64 is coupled to an A.C. power line to provide A.C. power to the motor/pump 38.

Another output of the microprocessor 60 is connected to the gate of a mosfet transistor 68 which connects D.C. power to the solenoid of the vacuum valve 34. A similar mosfet switch or gate may be employed to control the solenoid of the optional flap valve 40.

Microcontroller 60, in addition to providing timing and control of the vacuum pump, valves, etc., as described above, also performs system error checking. These error checking functions include monitoring excessive pump running time and detection of vacuum leaks by pressure a pressure drop in the absence of a flush event.

In operation, the flushing actuator 16 of the toilet 10 containing a waste water stream 18 is actuated. At the same time, the vacuum valve 34 is opened, and the flap valve 40 remains shut. At this moment, a volume of air is defined by the leading edge 46 of the waste water stream 18, the flap valve 40 and the interior surface of the discharge passage 20. When the vacuum valve 34 opens, the vacuum within the reservoir 36 draws the volume of air located in the discharge passage 20 into the reservoir 36. The valve 34 is then closed, as the waste water 18 is quickly drawn through the discharge passage 20. The length of time that the valve 34 is maintained in an open position is based on the particular system. For example, system variables can include the overall length of the discharge passage 20, the length of the discharge passage 20 between the toilet 10 and the valve 34, the desired degree of vacuum contained within the reservoir 36, the volume of fluid disposed between the leading edge 46 of the waste water and the flap valve 40 within the discharge passage 28, as well as any other pertinent factors. In establishing a period of time that the valve 34 is open, it is desirable to ensure that waste water stream 18 does not enter the valve 34 or the reservoir 36. The waste water stream 18 will flow past the closed vacuum valve 34 and proceed through the flap valve 40 to the discharge pipe 28.

The vacuum assisted toilet 10 of the present invention can also be practiced with a pressurized tank. Pressurized tanks are well known in the toilet art aid need not be described here. In the preferred embodiment of the current invention, a pressurized tank can be used so that the combination of pressurized tank and vacuum assisted flushing will provide the most efficient use of water in a flushing cycle.

The present invention also teaches a method for providing vacuum to assist in the flushing of a toilet described above. When the flushing actuator 16 is engaged, the control module 44 or microprocessor 60 activates the vacuum valve 34 to an open state. At this time, the flap valve 40, remains in a closed position. At this moment, the volume of air in the discharge passage 20 is defined by the leading edge 46 of the waste water stream 18, the flap valve 40, and in the interior surface of the discharge passage 20. When the vacuum valve 34 is opened, the vacuum within the reservoir 36 draws the volume of air in the discharge passage 20 into the reservoir 36. The valve 34 is then closed by the control module 44 or processor 60 as the waste water stream 18 is quickly drawn through the discharge passage 20 passes the location of the valve 34. The length of time that the valve 34 is maintained in an opened position is based on the particular system.

The waste water stream will then flow passed the closed vacuum valve 34 and proceed through the flap valve 40 which is moved to an open position to the discharge pipe 28.

Thus, there has been described a unique vacuum assisted toilet and method of operating a toilet in which a vacuum is drawn in a discharge passage between a waste water stream held in a toilet bowl and a controllable valve in the discharge passage intermediate the waste water stream in the toilet bowl and a discharge pipe extending to a holding tank, septic tank or sewer or other waste outlet. The vacuum assisted toilet of the present invention is easily implemented in an existing building structure and can accommodate one or multiple toilets in a single system with only a single vacuum source and vacuum reservoir. The vacuum assisted toilet of the present invention is extremely efficient insofar as the fact that the vacuum is applied to only a minimal amount of air so as to be able to quickly remove the air from the discharge passage for a quick evacuation of the waste liquid stream from the toilet bowl under the influence of a high vacuum pressure.

What is claimed is:

1. In a vacuum assisted system for a flushable toilet having a bowl capable of containing a waste liquid, a flushing actuator, and a discharge port, the improvement comprising:

a discharge passage having first and second openings, the first opening fluidly connectable to the discharge port of the flushable toilet, and the second opening connected to a waste outlet; and a source of vacuum;

a flap valve fluidically coupled in the discharge passage for controlling the flow of waste liquid trough the discharge passage, the flap valve being in a normally closed position at the time of actuation of a flushing actuator and during the application of vacuum to the discharge passage;

a valve fluidically coupled to the vacuum source and to the discharge passage between the flap valve and the first opening, the valve operative, in response to activation of the flushing actuator, to apply vacuum from the vacuum source to the discharge passage to withdraw waste liquid from the toilet bowl; and control means, responsive to the actuation of the flushing actuator, for controlling the valve, the control means being operative to maintain the valve in a position applying vacuum to the discharge passage for predetermined period of time after actuation of the flushing actuator, and closing the valve prior to the waste liquid from the toilet bowl reaching the valve in the discharge passage.

2. The improvement of claim 1 further comprising:

means for creating the source of vacuum;

a vacuum level switch for controlling a level of vacuum for the vacuum source; and the control means controlling the operation of the vacuum creating means, and the vacuum level switch.

3. The improvement of claim 1 further comprising:

a vacuum reservoir for storing the vacuum; and a vacuum level switch connected to the vacuum reservoir for modifying a level of vacuum within the vacuum reservoir.

4. A vacuum assisted toilet apparatus comprises:

a toilet having a toilet bowl capable of containing a waste liquid, a flushing actuator to initiate flushing of a discharge port communicating with the toilet bowls contents;

a discharge passage having one end in continuous direct fluidic communication with the discharge port of the toilet and another end fluidically connectable to a waste outlet;

a flap valve fluidically coupled in the discharge passage for controlling the flow of waste liquid trough the discharge passage, the flap valve being in a normally closed position at the time of actuation of a flushing actuator and during the application of vacuum to the discharge passage;

a valve fluidly connected to the discharge passage between the flap valve and the discharge port of the toilet;

a source of vacuum fluidically connectable to the discharge passage by the valve operable in response to activation of the flushing actuator to withdraw the contents from the toilet bowl through the discharge passage to the waste outlet;

a volume of air removed by application of the vacuum source to the discharge passage defined by the leading edge of the contents of the toilet bowl after activation of the flushing actuator, the interior of the discharge passage and the flow valve; and the source of vacuum is removed from the discharge passage prior to fluid reaching the valve connected to the discharge passage.

5. The vacuum assisted toilet apparatus of claim 4 further comprising:

means for creating source of vacuum;

a vacuum level switch for controlling a level of vacuum for the vacuum source; and a control means controlling the operation of the vacuum creating means, and the vacuum level switch.

6. The vacuum assisted toilet apparatus of claim 4 further comprising:

a vacuum reservoir coupled to the vacuum source; and a vacuum level switch connected to the vacuum reservoir for modifying a level of vacuum within the vacuum reservoir.

* * * * *